US009907353B2

(12) United States Patent
Lester et al.

(10) Patent No.: US 9,907,353 B2
(45) Date of Patent: Mar. 6, 2018

(54) ENERGY RETURN SOLE

(71) Applicants: Paul Walter Lester, Hurricane, UT (US); Brian Dean Owens, Plano, TX (US)

(72) Inventors: Paul Walter Lester, Hurricane, UT (US); Brian Dean Owens, Plano, TX (US)

( * ) Notice: Subject to any disclaimer, the term of this patent is extended or adjusted under 35 U.S.C. 154(b) by 642 days.

(21) Appl. No.: 14/216,111

(22) Filed: Mar. 17, 2014

(65) Prior Publication Data

US 2014/0259785 A1 Sep. 18, 2014

Related U.S. Application Data

(60) Provisional application No. 61/798,696, filed on Mar. 15, 2013.

(51) Int. Cl.
*A43B 13/18* (2006.01)
*A43B 13/02* (2006.01)

(52) U.S. Cl.
CPC ..... *A43B 13/026* (2013.01); *A43B 13/183* (2013.01); *A43B 13/185* (2013.01); *A43B 13/187* (2013.01)

(58) Field of Classification Search
CPC .... A43B 13/183; A43B 13/181; A43B 13/185
USPC ..... 36/27, 7.8
See application file for complete search history.

(56) References Cited

U.S. PATENT DOCUMENTS

| | | | | |
|---|---|---|---|---|
| 337,146 | A * | 3/1886 | Gluecksmann | A43B 3/0052 267/178 |
| 7,062,865 | B1 * | 6/2006 | Nordt, III | A43B 5/06 36/174 |
| 7,401,422 | B1 | 7/2008 | Scholz et al. | |
| 8,510,970 | B2 * | 8/2013 | Baum | A43B 13/183 36/27 |
| 2005/0108897 | A1 * | 5/2005 | Aveni | A43B 3/0068 36/27 |
| 2007/0271818 | A1 * | 11/2007 | Rabushka | A43B 13/183 36/38 |
| 2011/0138652 | A1 | 6/2011 | Lucas et al. | |
| 2012/0285040 | A1 * | 11/2012 | Sievers | A43B 13/183 36/27 |

FOREIGN PATENT DOCUMENTS

| | | | | |
|---|---|---|---|---|
| WO | WO 0074515 | A1 * | 12/2000 | A43B 13/183 |
| WO | WO 2011020798 | A1 * | 2/2011 | A43B 13/183 |

OTHER PUBLICATIONS

GWL, "Nike Ling Xiu Running Concept", http://work.wagonerlynch.com/Nike-Ling-Xiu-Running-Concept [retrieved from the Internet on Mar. 17, 2014], 2 pages.

* cited by examiner

*Primary Examiner* — Ted Kavanaugh
(74) *Attorney, Agent, or Firm* — Goodhue, Coleman & Owens, P.C.

(57) ABSTRACT

A energy sole including a base structure extending a length of a shoe sole, a flexion extending from the base structure, a toe arm extending forward from the flexion, and a heel arm extend rearward from the flexion.

19 Claims, 12 Drawing Sheets

ENERGY RETURN SOLE

RELATED APPLICATIONS

This application claims priority to pending U.S. provisional patent application Ser. No. 61/798,696 entitled "Energy Return Sole ", filed Mar. 15, 2013, the entire contents of which are hereby incorporated by reference in their entirety.

BACKGROUND

Footwear cushion and spring devices have been in use for years. Typically, footwear includes a rubber sole, a mid-sole attached to the rubber sole, and an upper. The upper is generally constructed of leather or similar material. Often, the mid-sole is generally constructed of a resilient foamed polyurethane type material for cushioning the user's feet during use. Some shoe brands include a pressurized pocket or coil springs located in the heel portion for providing increased cushioning during utilization.

In many cases, the designs of footwear do not provide the desired amount of cushioning and stability required for a high performance athletic shoe. In addition, conventional footwear typically does not provide an energy return system for increasing the overall efficiency of the shoe. While these devices may be suitable for the particular purpose to which they address, they are not as suitable for increasing the overall performance of a shoe by increasing the stability, shock absorption, and efficiency of the footwear.

SUMMARY

One embodiment provides an energy sole. The energy sole may include a base structure extending a length of a shoe sole, a flexion extending from the base structure, a toe arm extending forward from the flexion, and a heel arm extend rearward from the flexion.

Another embodiment provides an energy return sole. The energy return sole may include a base structure extending a length of a shoe sole, a toe arm extending forward from the base structure, and a heel arm extend rearward from the base structure, wherein the arm and the heel arm together form a V-spring.

BRIEF DESCRIPTION OF THE DRAWINGS

Illustrative embodiments of the present invention are described in detail below with reference to the attached drawing figures, which are incorporated by reference herein and wherein.

DETAILED DESCRIPTION OF THE DRAWINGS

The illustrative embodiments provide an energy absorption and return sole, system, and method of manufacture in accordance with illustrative embodiment. The energy sole may be utilized in any number of shoes, prosthetics, boots, robotic appendages, contact points, and other footwear. The energy sole may be utilized as a stand-alone sole or as an integrated part of a sole or footwear system. The energy sole may be particularly useful for athletics, work shoes, or so forth.

The energy sole may be utilized externally or enclosed within a sole. For example, the energy return sole may be utilized in an "open air" approach where the different extensions and features of the energy return sole are the rebounding and energy absorption components that separate the user from the ground. The energy return sole may also be configured in a closed or sealed configuration where it is sealed to prevent entry of outside elements. For example, one or more elastic, rebounding, or separation materials may be sealed, inserted between, or fill the spaces between the different features and extensions of the energy return sole to further enhance the energy return forces generated by the energy return sole in response to applied user forces. The materials may also be utilized to reduce noise and provide additional comfort to the user in addition to aiding dampening, recoil, and energy return.

Figure 1:
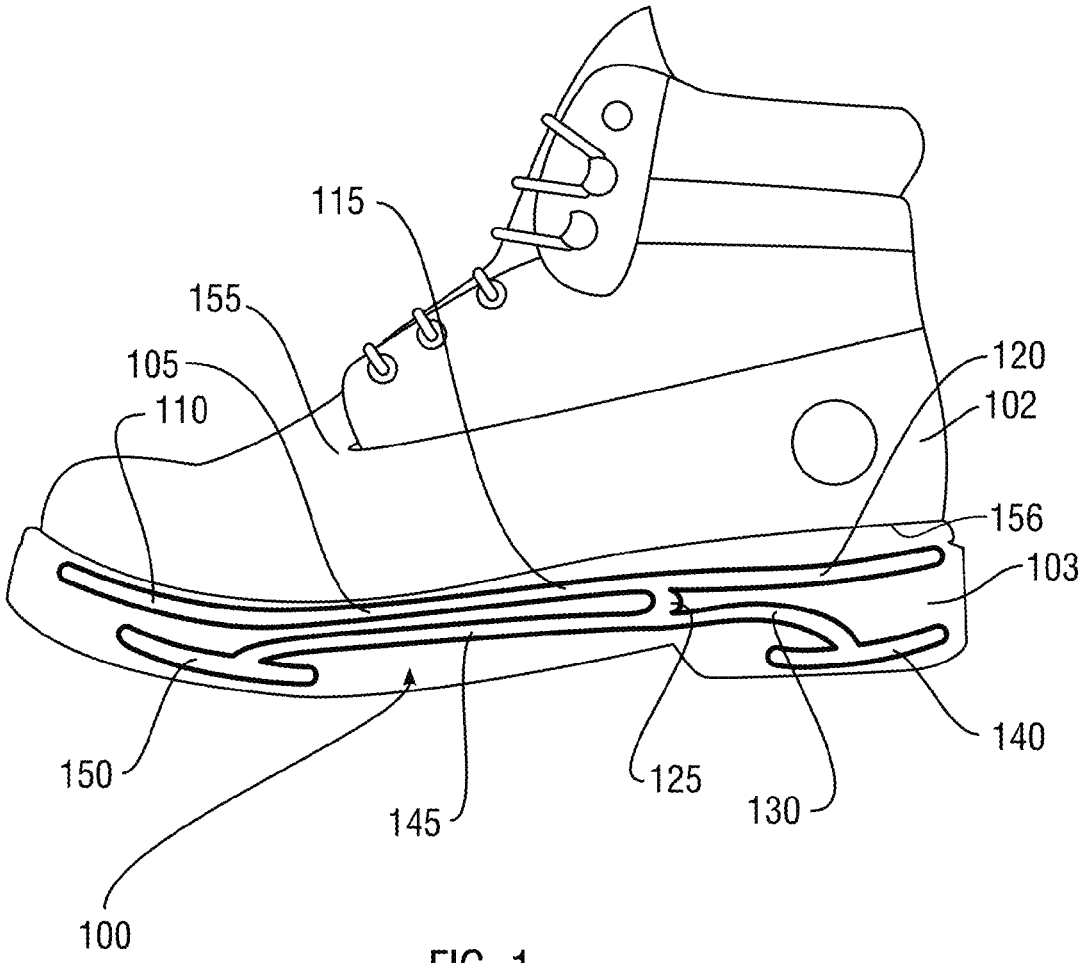
FIGS. 1-12 are schematic, side views of various energy return soles in accordance with illustrative embodiments.

FIG. 1 is a pictorial representation of side view of an energy sole 100 of a shoe 102 in accordance with an illustrative embodiment. In one embodiment, the energy sole 100 may include a flexible sole 105, a toe portion 110, an arch portion 115, a heel portion 120, a flexion 125, a heel extension 130, a heel contact 140, a midsole arm 145, and a toe contact 150.

The embodiment, of FIG. 1 may further include an upper 155 including, an insole, a midsole, and an outsole (not called out) as are known in the art. In one embodiment, the energy sole 100 may be referred to as a flexion energy absorption and return (F.E.A.R) system.

In one embodiment, the energy sole 100 is an integrated portion of the shoe 102. For example, the energy sole 100 may be glued, sewed, welded, riveted, inserted, integrated, or otherwise attached to a shank 156 of the upper 155. The flexible sole 105 may be attached to the upper 155 portion of the shoe to provide stability and effective energy transfer. The shank 156 may separate an upper 155 portion of the shoe from a lower portion including the energy sole 100. In another embodiment, the energy sole 100 may be attached or integrated with the upper 155.

In one embodiment, the energy sole 100 may be formed of a carbon fiber, plastic polymer, aluminum, steel, fiberglass, thermoplastic composites (e.g. Tegris, Pure, etc.), graphene, graphite, fiberglass, or other composite. One or more portions may be injection molded using one of the aforementioned materials such as a thermoplastic polyurethane (TPU). Other materials such as polyamide or other composites may be used with a fiber loaded material. One or more of the materials may be layered or embedded whereby one material provides a greater portion of the absorption while another material provides a greater portion of the recoil affect, such as where one has a greater modulus of elasticity. The energy sole 100 may be formed of any material that is both elastic and rigid enough to deform and return energy to the user during utilization. In one embodiment, the energy sole 100 includes or is coated with a rubberized material or other material to provide longevity and noise suppression, such as preventing a striking sound between components of the energy sole 100 (e.g. flexible sole 105 and midsole arm 145) during intensive utilization (e.g. running, jumping, etc). The coating may also be utilized to provide increased durability. The energy sole 100 may be utilized to decrease temperature transfer into the upper 155 to maintain a desired foot temperature.

In one embodiment, the flexible sole 105 provides a base, frame, or support structure for the energy sole 100. As previously described, the flexible sole 105 and the shank may be integrated. The flexible sole 105 may be more rigid or have a greater torsional stiffness or modulus of elasticity than the rest of the energy sole 100. For example, the thickness of the flexible sole 105 may be greater to provide additional rigidity. In another example, the flexible sole 105 may be formed of a more rigid material. In one embodiment, reflexive portions of the energy sole 100 may be linked to the flexible sole 105 by the flexion 125. The flexion 125 is an energy capture component. In one embodiment, the flexion 125 is substantially U-shaped, V-shaped, (symmetrical, asymmetrical) or so forth. The flexion 125 may be defined by the structure between the flexible sole 105 and the midsole arm 145. The flexion 125 may include one or more components or supports, such as one or more embedded stiffening elements. In another embodiment, the flexion 125 may be diagonally positioned between the flexible sole 105 and the midsole arm 145.

A heel extension 130 may extend from the flexion in a first direction. The heel extension 130 may be an arm or member connecting the flexion 125 to the heel contact 140. In one embodiment, the heel extension 130 may have a curved or arced shape. The heel extension 130 may extend downward to the heel contact 140. In another embodiment, the heel extension 130 is straight. The flexion 125 may also connect to the midsole arm in a second direction. The midsole arm 145 may extend to connect to or form the toe contact 150. The heel extension may be configured and/or include material portions discussed above to control stiffness and elasticity.

In one embodiment, the energy sole 100 may include at least two contact points including the heel contact 140 and a toe contact 150. In one embodiment, the heel contact 140 and the toe contact 150 may extend laterally across the shoe 100. The heel contact 140 and the toe contact 150 may be larger pads (e.g. rectangular, square, or semi-circular pads) as shown, for example, in FIG. 13.

The heel contact 140 provides the primary point or section of energy absorption toward the heel (or rear of the energy sole 100) while the toe contact 150 provides the same for the toe (or front of the energy sole 100). In one embodiment, the heel contact 140 and the toe contact 150 may extend from both sides of the heel extension 130 and the midsole arm 145. In another embodiment, the heel contact 140 may extend from the heel extension 130 only towards the back of the energy sole 100 (e.g. towards the heel of the shoe 102) and the toe contact 150 may extend from the midsole arm 145 only towards the front of the energy sole 100 (e.g. towards the front of the shoe 102).

The heel contact 140 and the toe contact 150 are compressed or biased toward the user's foot and the flexible sole 105 during the natural walking or running motion of the user. This compression action may cushion the user's stride while simultaneously absorbing energy that may be subsequently returned to the user during the rolling motion that corresponds to walking or running. Similarly, the energy is returned through the energy sole 100 based on the compression and spring constants of the material making up the energy sole 100. The heel contact 140 may be configured with linear or non-linear stiffness and elasticity along either lateral or transverse portions. The energy may be primarily returned through the heel contact 140 and the toe contact 150 to further drive the user's motion. In one embodiment, the heel contact 140 and the toe contact 150 may extend on either side of the ends of the heel extension 130 and the midsole arm 145, respectively. This configuration may further protect the ends of the heel extension 130 and the midsole arm 145 from point stresses, catching on objects or structures, or so forth. The heel contact 140 and the toe contact 150 may further distribute the impact from the associated activity and return forces that are provided by the energy sole 100.

In one embodiment, the heel portion 120 and the heel contact (including the heel extension 130) may be compressed toward one another during utilization. The arch portion 115 and midsole arm 145 may similarly be compressed toward one another during utilization. In one embodiment, as the user's foot rolls forward, a point substantially between the arch portion 115 and the toe portion 110 may be compressed against the midsole arm 145 to provide additional stiffness and decrease the length of the lever arm for the midsole arm 145. The midsole arm 145 may act as a pivot point further flexing the toe contact 150 and the toe portion to have an increased range of motion for returning energy as the user rotates the toe of the shoe 102.

In one embodiment, the energy sole 100 is not enclosed and open. In another embodiment, the energy sole 100 is enclosed in an outsole. For example, the energy sole 100 may be overmolded within the outsole for providing protection from the elements (water, rocks, dirt, gravel, objects, etc). For example, the outsole may represent any typical outsoles utilized by various brands, such as Nike, Adidas, Reebok, Sketchers, Puma, Swiss, or other manufacturers. The outsole may cover all or portions of the energy sole 100. For example, the heel contact 140 and the toe contact 150 may extend separately from the outsole. The outsole may provide traction, abrasive resistance, and protection for the energy sole 100, shoe sole 103, and shoe 102 in general.

In other embodiments, the energy sole 100 may include lateral arms that extend from the sides of the energy sole 100 to provide additional lateral stability and energy return. In one embodiment, the energy sole 100 may be configured to include the flexion 125 and the portions of the energy sole 100 above the flexion 125. Instead, the midsole arm 145 and other respective portions may be connected to or integrated with the shank 156 or other portion of the shoe 102.

Figure 2:
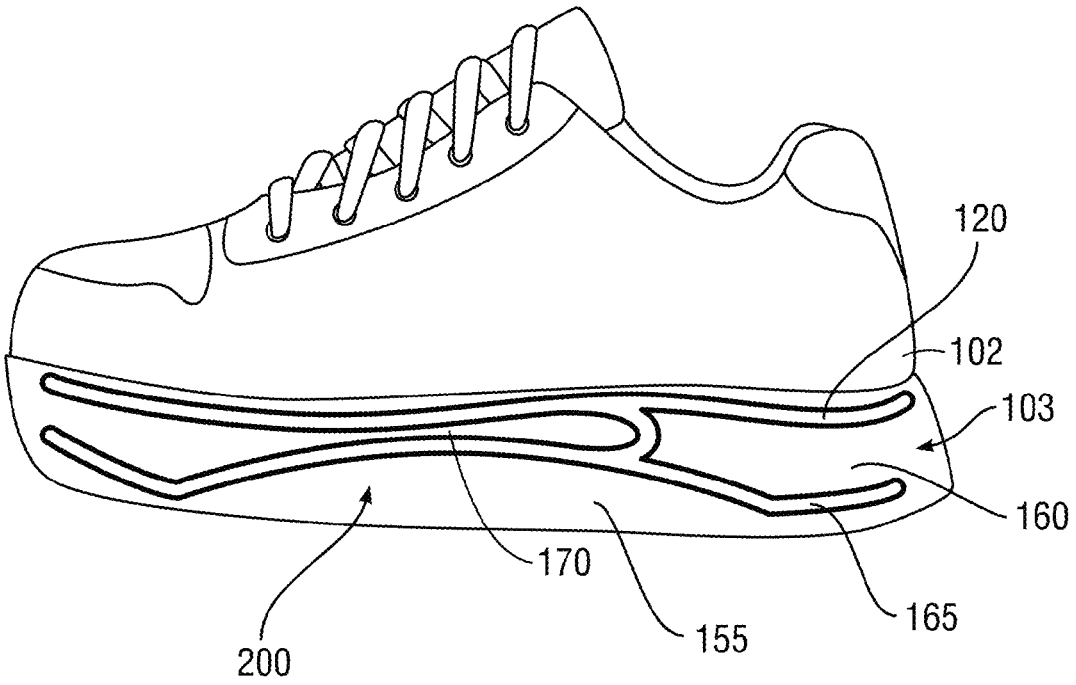

FIG. 2 is a pictorial representation of another energy sole 200 in accordance with an illustrative embodiment. The energy sole 200 may include similar components and structures to the energy sole 100 of FIG. 1 that are not specifically described for purposes of simplicity and to avoid redundancy.

In FIG. 2, the curve of a midsole arm 170 is further increased to absorb more energy after the user's heel strikes. As a result, a space 155 between a bottom portion of the shoe sole 103 and the midsole arm 170 is increased thereby providing additional capacity for the energy sole 200 to absorb energy, store it, and return it as weight or pressure is removed from the energy sole 200.

The energy sole 200 further includes an increased space 160 between the heel portion 120 and a heel extension 165. As a result, additional energy may be absorbed and stored as the heel extension 165 moves toward the heel portion 120 during the heel strike.

The energy sole 200 may also be configured for simplicity by reducing points of failure and simplifying the complexity of the manufacturing process. For example, the heel extension 165 may be extended to integrate or include a heel contact and the midsole arm 170 may be extended to integrate or include the total contact (differently from what was shown and described in FIG. 1). The longer heel extension 165 and midsole arm 170 may further simplify the manufacturing process and provide less points of failure for the energy sole 200.

The spaces between the different components of the energy soles as are herein described may vary based on the needs of the user. For example, the spaces between the components for absorbing large amounts of energy may not be required for daily use. Instead small consistent amounts of energy storage may be most comfortable to the user and provide an energy return that the user expects. In other embodiments, the spaces may be increased to absorb more energy to the user. High energy return may be desirable for intensive activities, such as sports, intense work activities, or so forth. For example, if a user is required to jump or run extensively, larger or increased energy spaces may be desirable. The spaces may be specially configured including having one or more materials to aid dampening and recoil of the energy sole 200 for the types of activities associated with the shoe 102.

Figure 3:
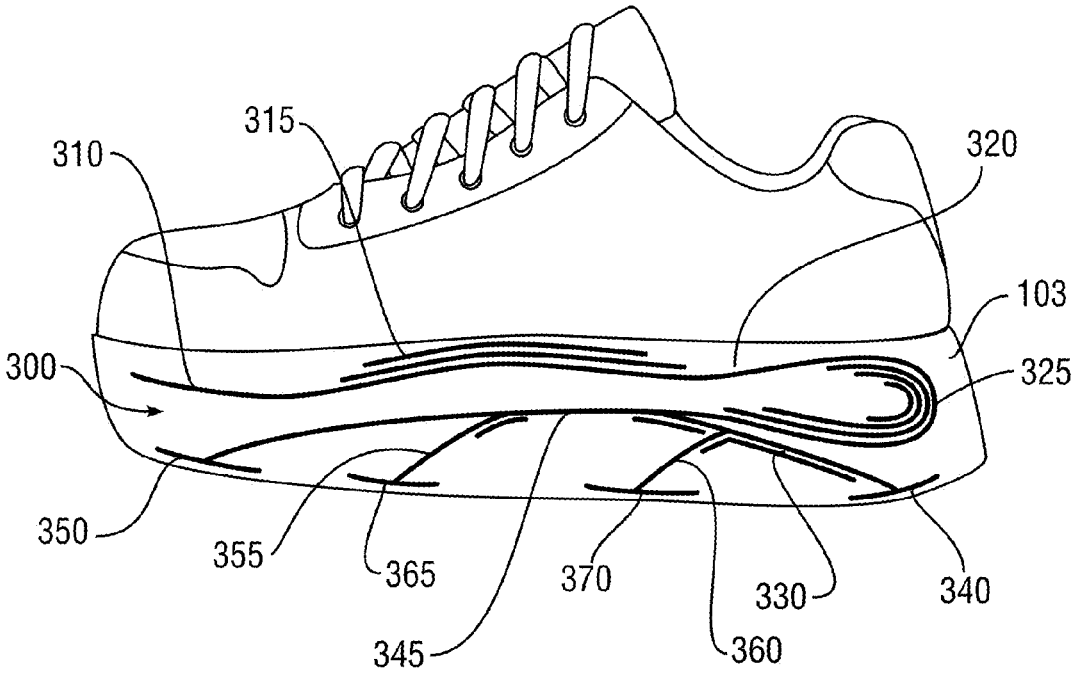

Turning now to FIG. 3 illustrating another embodiment of an energy sole 300. The energy sole 300 may similarly include a toe portion 310, an arch portion 315, a heel portion 320, a flexion 325, a heel extension 330, a heel contact 340, a midsole arm 345, a toe contact 350, arms 355 and 360, and midsole contacts 365 and 370.

In one embodiment, the energy sole 300 may include one or more layers of materials, such as a laminate or one or more layered materials housed within another material of varying stiffness and elasticity. The one or more layers may vary in stiffness or elasticity to create a combined response. The points of the energy sole 300 that are likely to receive the most weight, forces, and stress may be reinforced utilizing multiple layers or different materials to further support the longevity and energy storage capacity of the energy sole 300. For example, the flexion 325 may include multiple layers to support the bending motions that are applied thereon based on the lever motion of the energy sole considering the different components, such as the toe portion 310, arch portion 315, and heel portion 320 as one part of an arm and the midsole arm 345 as another arm that may bend about the flexion 325.

The energy sole 300 may include various components with different support levels as shown by the multiple lines associated with the arch portion 315, flexion 325, heel extension 330, and the arms 355 and 360. The energy sole 300 may include additional spaces for the energy sole 300 to compress to store energy that is then again released to the user. In one embodiment, the heel extension 330 and the arms 355 and 360 may be diagonally positioned to deform against the flexion 325 and the midsole arm 345 when absorbing energy to provide additional or a different stiffness and/or elasticity responses. Likewise, the midsole arm 345 may deform or bend against the toe portion 310, the arch portion 315, and the heel portion 320 to provide similar responses. The energy sole 300 may provide different angles for absorbing the energy associated with the feet strikes or impacts of the user. As shown, the heel extension 330, the arms 355 and 360, and the midsole arm 345 are configured to act as cantilever springs (linear flex springs) for absorbing energy and returning it to the user through the energy sole 300 utilizing a springboard affect. In addition, the angle of the heel extension 330, the arms 355 and 360, and the midsole arm 345 may be configured (and varied) to drive the user forward when running, walking, or otherwise moving from point-to-point. The use of one or more linear flex springs/arms as are shown by the energy sole 300 may provide additional methods of absorbing impact and returning energy to drive the feet of the user.

As shown, the various extensions or arms, such as the heel extension 330 may also be connected to other arms, such as the arm 360. As previously described, the contacts 350, 365, 370, and 340 may be contained within the shoe sole 103 or may be configured to protrude.

Figure 4:
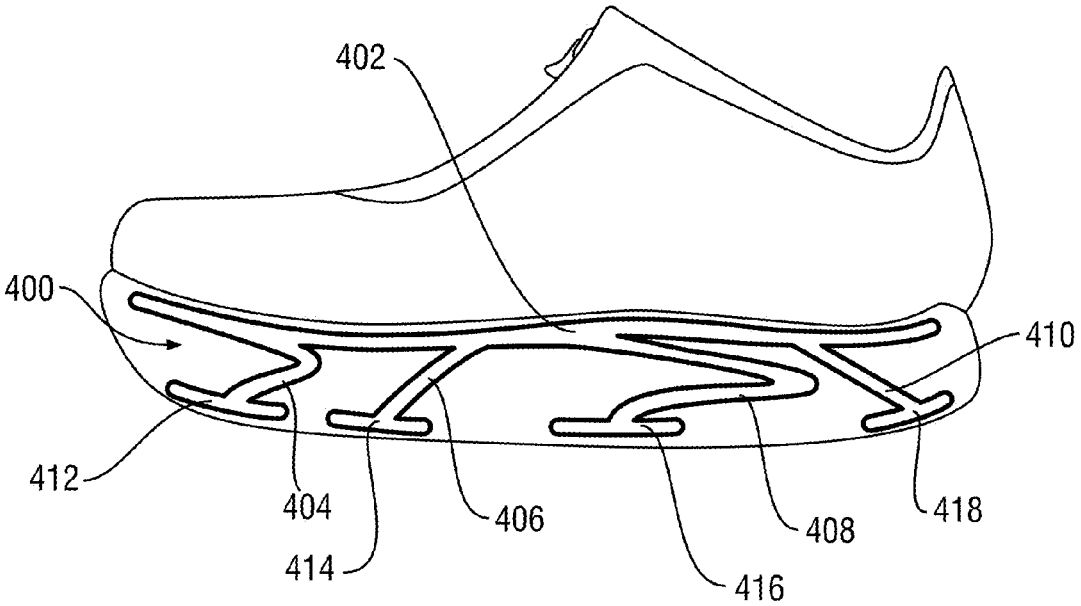

FIG. 4 illustrates another embodiment of an energy return sole 400. The energy return sole 400 may include any number of components including a base support 402, arms 404, 406, 408, and 410, and contacts 412, 414, 416, a 418. The base support 402 may include the toe portion, the arch portion, and the heel portion as were described in the other embodiments.

The arms 406 and 410 may extend at a single or a variety of angles from the base support 402. The arms 406 and 410 may act as cantilever springs to the foot of the user and driving the user. The arms 404 and 408 may be configured as V-springs (e.g., V-shaped springs) that extend from the base support 402. The arms 404 and 408 may be configured to deform or capture energy utilizing a number of lever arms. The arms 404 and 408 may allow for additional energy capture based on the stiffness and elasticity of one or more contemplated materials of the energy sole 400. The connection points of the arms 404-410 to the base plate provide a way of returning energy back through the respective contacts 412-418.

Figure 5:
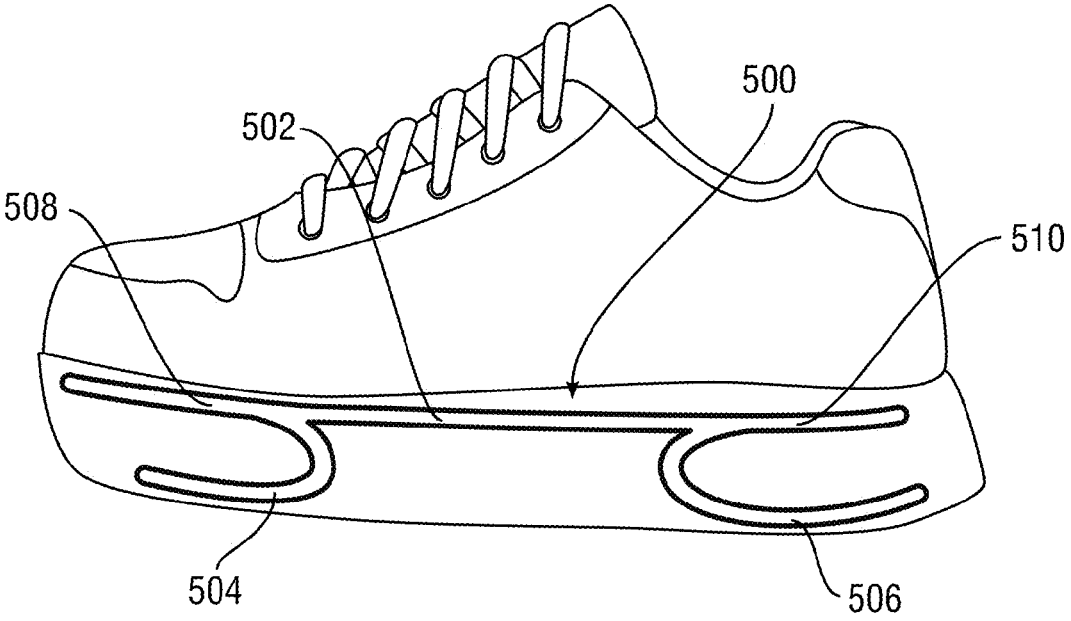

FIG. 5 illustrates another embodiment of an energy sole 500. The energy return sole 500 may include a base support 502 and curved supports 504 and 506. In one embodiment, the curves structures 504 and 506 may be integrated with a first end 508 and a second end 510 of the base support 502.

In one embodiment, the curved supports 504 and 506 may represent C-springs (e.g., C-shaped springs). In one embodiment, a top portion of the C-springs may be integrated with the first end 508 and the second end 510. In one embodiment, the curved supports 504 and 506 may be concentrated at the toe and heel portions of the shoe. In another embodiment, the energy sole 500 may include a third curved structure positioned at the midsole of the energy sole 500. However, any number of curved structures or arms, such as C-springs, V-springs (e.g., V-shaped springs), and cantilever springs may be integrated within the energy sole 500 and, for example, housed within one or more other materials having the same or different stiffness and elasticity. In another embodiment, a number of small curved structures may be evenly distributed along the base support 502. The spaces defined between the curved structures 504 and 506 and the first end 508 and the second end 510 may control the amount of energy stored by the energy return sole 500. As a result, the spacing between the different components may be varied based on the level of absorption required.

Although the open portion of the curved supports 504 and 506 are shown as facing outward from the energy sole 500. In other embodiments, all or a portion of the curves structures may be aligned in the same direction or alternating directions. In one embodiment, the energy sole 500 may be configured as shown to drive the foot of the user forward. The curved structure 504 may also be shorter than the first end 508 to support a rolling motion off of the front of the foot. The length of the base support 502 and the corresponding length of the curves structures 504 and 506 may vary between equal, shorter, and longer. In another embodiment, the curved structures shown in either of FIGS. 11 and 12 may be utilized with the energy sole 500.

Figure 6:
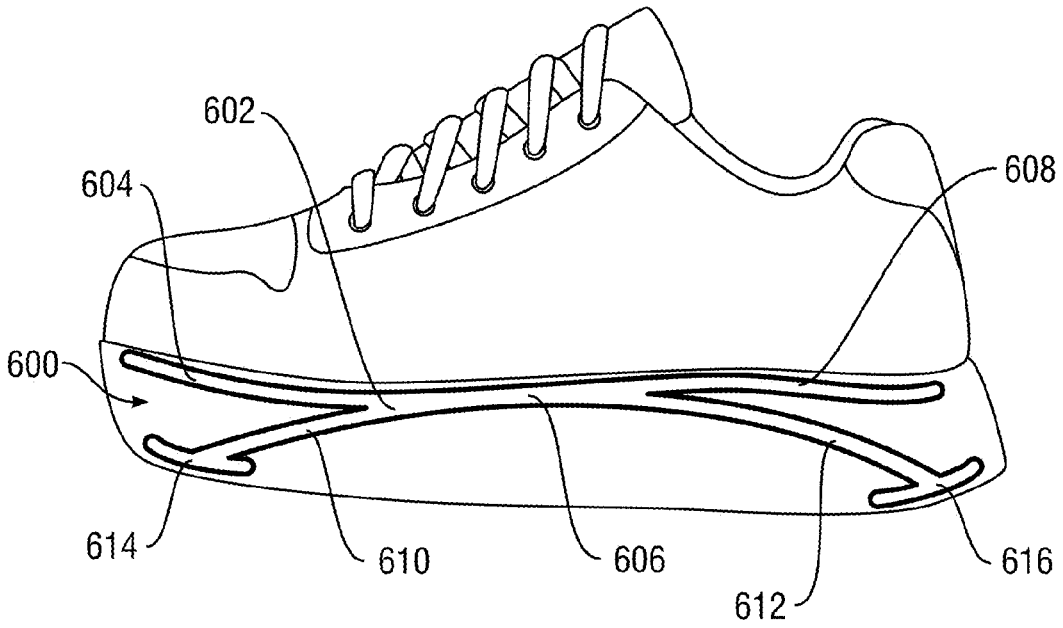

FIG. 6 illustrates another embodiment of an energy sole 600. The energy sole 600 may include a base support 602 including a toe portion 604, a midsole portion 606, and a heel portion 608. The energy sole 600 may further include a toe arm 610 and a heel arm 612 and corresponding toe contact 614 and heel contact 616.

As shown in FIG. 6, the various embodiments of the base support 602 may also be configured to curve to the shape of the foot. The energy sole 600 may incorporate features of C-springs, V-springs (e.g., V-shaped springs), and cantilever springs. For example, the base support 602 and the extending toe arm 610 and heel arm 612 may form a large, substantially open, C-spring within the open portion facing down (or towards the ground), the toe portion 604 and the heel portion 608 may flex against the main body of the base support 602 as a cantilever or plate spring, and the front portion and rear portion of the energy sole 600 including the toe portion 604 and the toe extension 610 and the heel portion 608 and the heel arm 612 may form V-springs (e.g., V-shaped springs). Any number of materials, including the aforementioned materials, may be used to control stiffness and elasticity of the C-spring.

As previously described, the toe contact 614 and the heel contact 616 may extend from both ends of the toe arm 610 and the heel arm 612, respectively. In another embodiment, the toe contact 614 and the heel contact 616 may be integrated with the toe arm 610 and the heel arm 612, respectively.

As shown, the energy sole 600 may have a substantial X shape or K-shape. In one embodiment, the toe arm 610 and the heel arm 612 may be connected at a pivot or attachment point. In another embodiment, the toe arm 610 and the heel arm 612 may be completely separated. For example, the toe arm 610 may attach at a rear or rear portion of the base support 602 and the heel arm 612 may be attached at a front or front portion of the base support 602. For example, the toe arm 610 may be define an opening through which the heel arm 612 extends to the rear of the energy sole 600. As a result, the toe arm 610 and the heel arm 612 may absorb energy, flex, and return energy independently to best adapt to a user's walking or running style. The crossing point of the toe arm 610 and the heel arm 612 above the toe arm 610 and the heel arm 612 and below the base support 602 may include a fulcrum or support (not shown) for further loading the position and motion of the heel arm 612 and the toe arm 610. For example, the fulcrum may have a flattened triangular shape for supporting the toe arm 610 and the heel arm 612. In one embodiment, the fulcrum may be removed or adjusted to increase or decrease the springiness or energy absorbed and returned by the energy sole 600. The fulcrum may be integrated with the base support 602, toe arm 610, heel arm 612 or may be separately connected. As a result, the different components of the energy sole 600 may be interleaved or separately connected to the base support 602 or other portion of the energy sole 600 to separate, distinct, and independent motion of the different components. The toe arm 610 and heel arm 612 may also be arced or curved to increase the return profile of the energy sole 600. Although, not explicitly shown, the energy sole 600 may have a substantial K-shape with the toe arm 610 and the heel arm 612 extending as the diagonal arms of the K.

Figure 7:
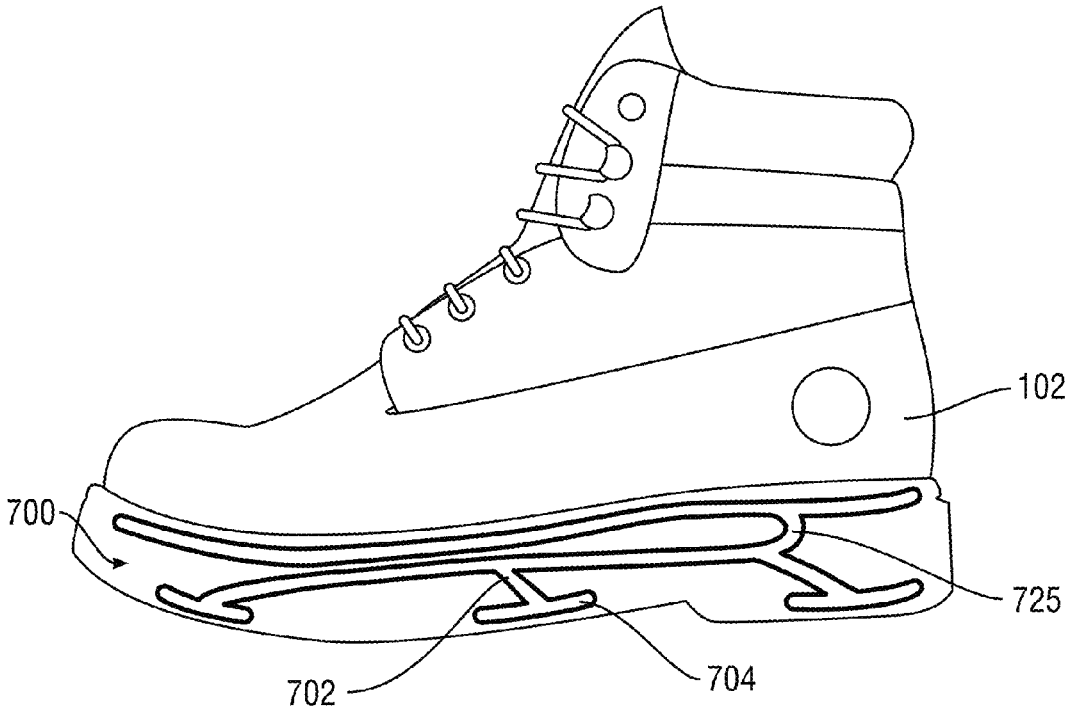

FIG. 7 illustrates another embodiment of an energy sole 700. The energy sole 700 is similar to the energy sole 100 of FIG. 1. In one embodiment, the flexion 725 is positioned more toward the rear of the shoe 102. In one embodiment, the flexion 725 may represent more of a rolling motion of the energy sole 700 during usage about the flexion 725 that act as a bending or deforming fulcrum point. The energy sole 700 may be configured more akin to energy sole 100 of FIG. 1 to better distribute loading front and rear portions of the energy sole 100 based on the support and fulcrum that the flexions 125/725 provide. The energy sole 700 may also include a midsole arm 702 and contact 704 for increased energy absorption and return across the middle of the foot. The flexicon 725 may be configured from different types and makeup of materials depending where positioned in the energy sole 700.

Figure 8:
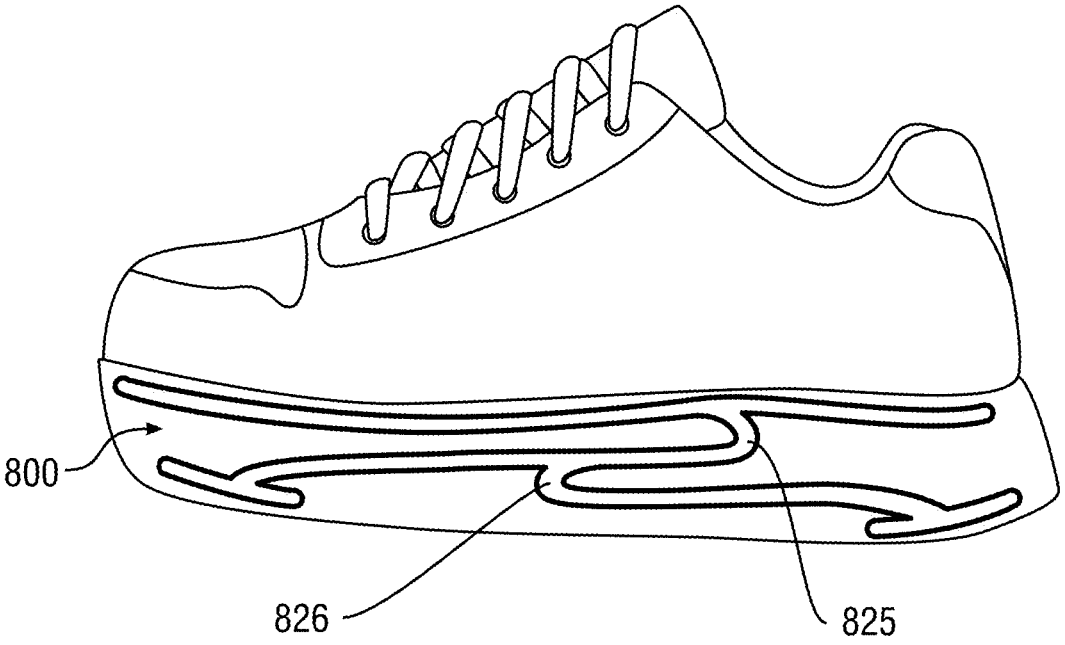

FIG. 8 illustrates another embodiment of an energy sole 800. The energy sole 800 is also similar to the previous embodiments. However the energy sole 800 may include flexions 825 and 826. The flexions 825 and 826 may further absorb energy from the midsole impact. In one embodiment, all or portions of the energy sole 800 may be formed of materials that may be compressed based on the foot strike of the user. In another embodiment, the various arms and supports of the energy sole 800 may be formed of a flexible material, and the flexions 825 and 826 may be formed of a stiffer material to provide the energy return needed by the user. In one aspect, the stiffer material may be embedded or housed with the more flexible material.

Figure 9:
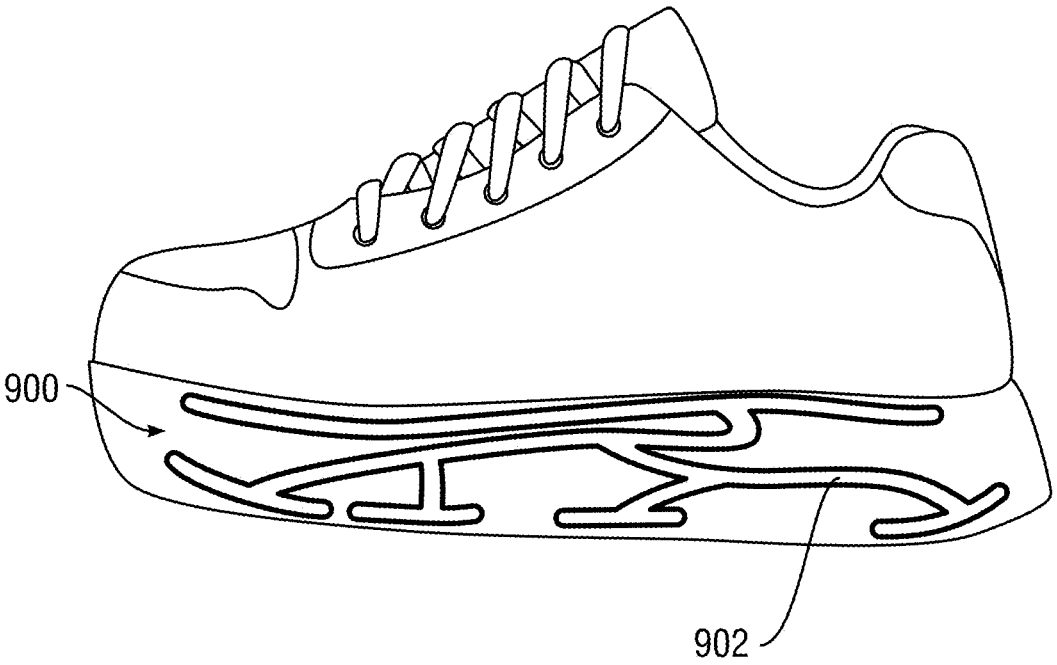

FIG. 9 illustrates another embodiment of an energy sole 900. As previously mentioned, the placement of the flexions, arms, V-springs (e.g., V-shaped springs), and contacts may vary. The arms and extensions may also be curved in shape to further return energy to the user. For example, heel extension 902 may have a substantially curved shape. Curved extensions, arms, and contacts may allow the energy sole 900 to be utilized with traditional outer sole shapes and configurations.

Figure 10:
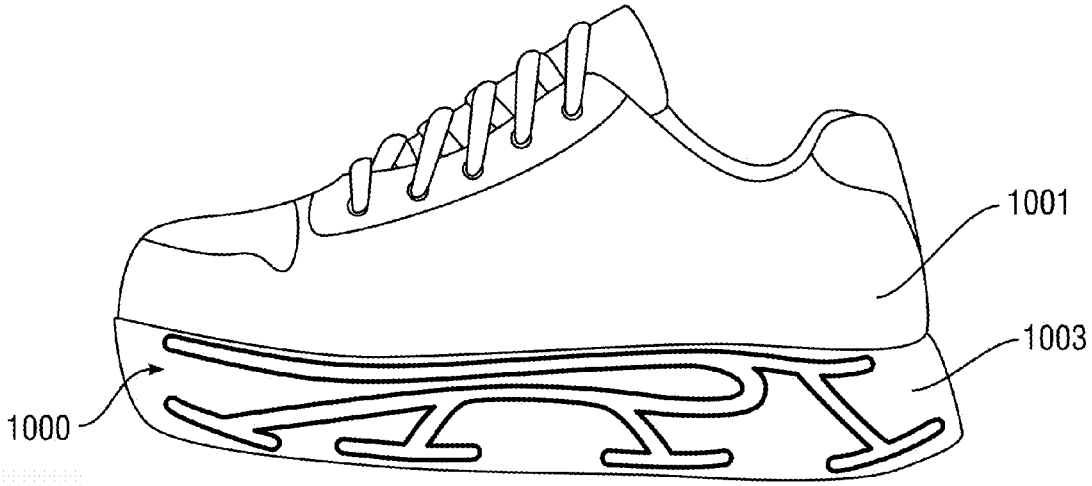

FIG. 10 illustrates another embodiment of an energy sole 1000. The size and length of the various flexions, arms, extensions, and contacts may vary. The angles may also vary to provide a more rigid or flexible feel to the energy sole 1000. Although not specifically shown, the contacts may extend across an entire width of the shoe sole 1003 and/or taper in longitudinal and transverse directions. The contacts may include traction, gripping surfaces, protrusions, or so forth. The contacts may also have an arched, bowed, or curved shape for additional energy absorption and return. For example the contacts may be C-shaped with the ends of the C being positioned on the left and right sides of the shoe 101 when looking from above.

Figure 11:
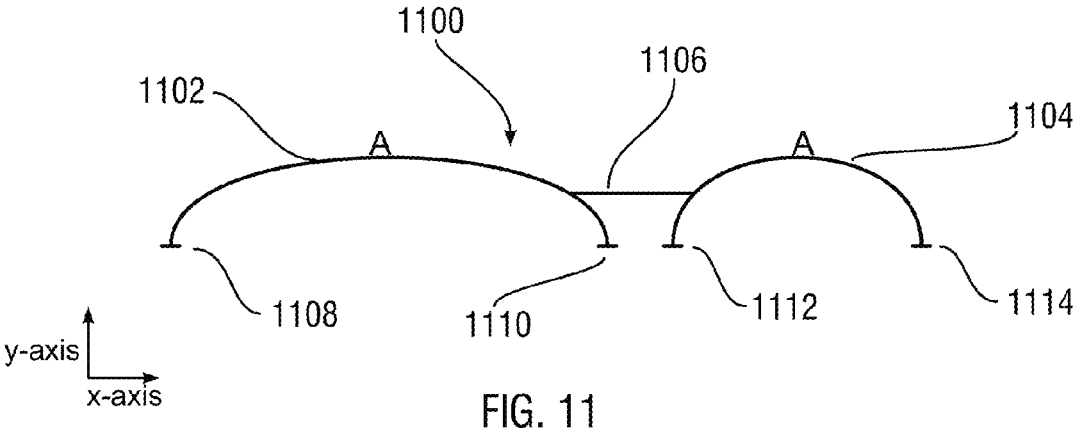

FIG. 11 illustrates an energy sole 1100 that utilizes curved supports 1102 and 1104. In one embodiment, the curved supports 1102 and 1104 may be arched or half ellipse shaped. For example, the curved supports 1102 and 1104 may be an upper portion of an ellipse split along a major axis (i.e. split at the vertices along the x-axis). The curved supports 1102 and 1104 are configured to flex and then return energy back to the user during utilization. The curved supports 1102 and 1104 may also be referred to as arms or extensions.

In one embodiment, the curved supports 1102 and 1104 may be linked by a connector 1106. The connector 1106 may be connected at any point of the curved supports 1102 and 1104. In one embodiment, the connector 1106 may be connected near a bottom portion of the curved supports 1102 and 1104 as shown. In another embodiment, the connector 1106 may be connected at the near ends of the curved supports 1102 and 1104.

In another embodiment, the connector 1106 may be connected between the two vertices (A) along the minor axis (y-axis) of both of the curved supports 1102 and 1104. In yet another embodiment, the connector 1106 may be curved and may be configured to be integrated with the outside edges of the curved supports 1102 and 1104 beyond the vertices of the minor axis.

In one embodiment, the ends of the curved supports 1102 and 1104 may be connected to contact 1108, 1110, 1112, and 1114. The contacts 1108, 1110, 1112, and 1114 may also be referred to as feet. As previously described, the contacts 1108, 1110, 1112, and 1114 may protect the ends of the curved supports 1102 and 1104 from excessive stress, material fatigue, or catching during utilization of the energy sole 1100.

In one embodiment, the energy sole 1100 may also include a base plate (not shown) that sits on the curved supports. The base plate may represent a sole of a shoe or other support structure for the shoe. The components of the energy sole 1100 may be encompassed in any number of protective layers and outer sole components as are known in the art. All or portions of the energy sole may be displayed through transparent windows in the shoe sole to view the functionality and flexing of the components of the energy sole 1100. Displaying the movement and functionality of the energy sole 1100 may be particularly important for education and marketing purposes. In another embodiment, the energy sole 1100 may be flipped horizontally for utilization. For example, the contacts 1108, 1110, 1112, and 1114 may be interconnected to form a base supporting the curved supports 1102 and 1104.

Figure 12:
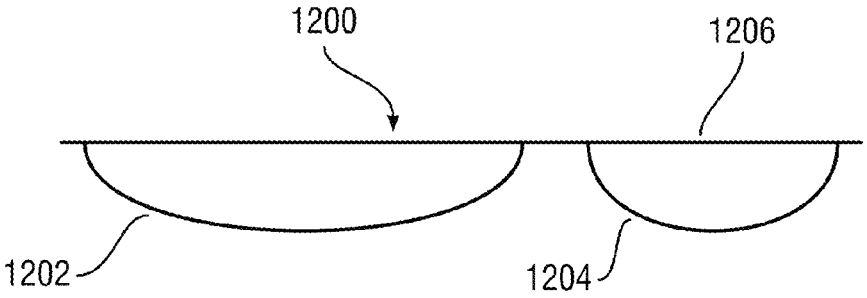

FIG. 12 illustrates an energy sole 1200 in accordance with an illustrative embodiment. The energy sole 1200 may include curved supports 1202 and 1204 and a base support 1206. The curved supports 1202 and 1204 may also be a half ellipse shape. For example, the curved supports 1202 and total four may represent a bottom portion of an ellipse split along the major axis.

As previously described, the curved supports 1202 and 1204 may be configured to deform or store energy when impacted against the ground or other surface. The curved supports 1202 and 1204 may then return the energy to the user through the energy sole 1200. In one embodiment, the base plate 1200 may be integrated with the sole of a shoe and may be rigid, semi-rigid, or flexible. In another embodiment, all or portions of the base plate 1206 may be configured to stretch laterally (along the x-axis) to encourage the deformation and energy storage of the curved supports 1202 and 1204. The base plate 1206 may be formed of a material that encourages stretching or may have mechanical components, such as miniature rails, slides, or so forth. In another embodiment, the structure of the base plate 1206 may encourage stretching in one or more directions utilizing hollowed structures (e.g. miniature triangular trusses, honeycombs, etc.).

Figure 13:
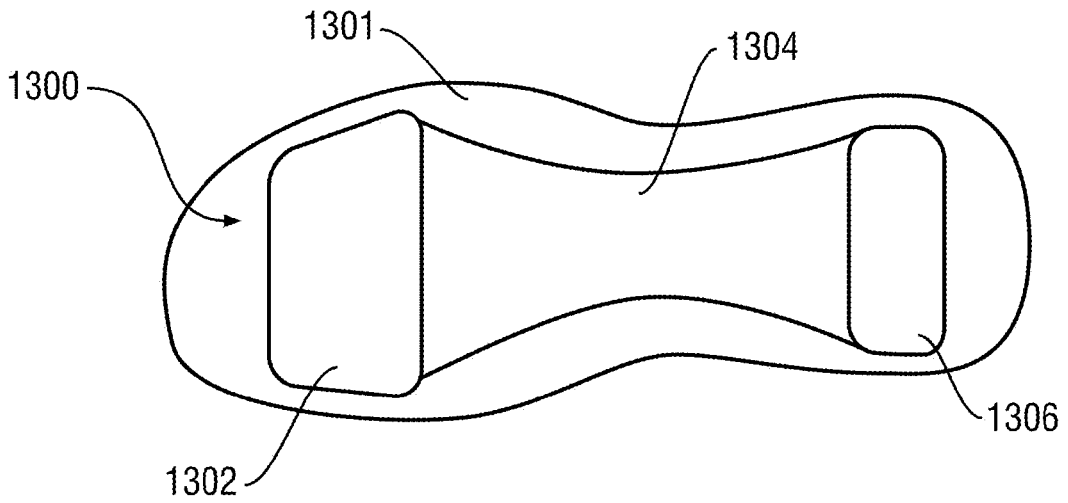
FIG. 13 is a bottom view of an energy return sole in accordance with an illustrative embodiment.

Turning now to FIG. 13 illustrating a bottom view of an energy return sole 1300. The energy sole 1300, similar to those previously disclosed, includes a toe contact 1302 and a heel contact 1306 spaced apart by a midsole arm 1304 operably arranged on a shoe sole 1301 (i.e., outsole). As pictorially represented, the toe contact 1302 and heel contact 1306 may be configured to extend across an entire width or a partial width of the shoe sole 1301. The midsole arm 1304 may be configured to have a width commensurate with the toe contact 1302 and/or heel contact 1306. The midsole arm 1304 may also be configured with a taper along one or more of its edges between the toe contact 1302 and heel contact 1306. Alternatively, the midsole arm 1304 may be configured to thicken or swell along its length between the toe contact 1302 and heel contact 1306.

The various embodiments of the energy sole may be generated utilizing any number of processes, such as molding, forging, carbon fiber generation. In one embodiment, the energy sole may be created utilizing one or more molds. The molds may be utilized to create the energy sole from carbon fiber, plastic composites, polymer composites, steel (or other metals, or other composite materials, or other materials as discussed herein. For example, the energy sole may be manually or automatically created utilizing carbon fibers and then set utilizing any number of resins, heating, and stamping processes. The carbon fiber may be laid or aligned to flex to provide the best energy return during the foot strike of the user. Materials may also be chosen based on weight. For example, steel may be utilized for work boots and carbon fiber may be utilized for running shoes. In another embodiment, the energy sole may be forged or stamped. In addition, the connection points and components of the energy soles may be created during molding, welded, stamped, adhered, or integrated one with another. Although the energy sole is described as having components. In some embodiments, the components may be formed to create a single structure or a single unit of material.

The energy sole may also be generated utilizing a three dimensional printing process utilizing any of the materials herein described or that may become available having the properties or characteristics that are desirable for the energy return sole. For example, a 3D printer may be utilized to print a carbon fiber energy return sole that is integrated with an upper of a shoe to provide a dynamic shoe or shoe system. The energy sole may also be coated with or encapsulated in any number of materials for long term protection from outside elements. Various energy sole designs may also be sold over the Internet (e.g., websites, e-commerce), through retailers, or through a licensing practice for printing by individual users and integration with any number of applicable shoe or other systems. As a result, the user may be able to customize the size, widths, stiffness, and other characteristics of the energy return sole for their height, weight, intended use, physicality, desired response and so forth. For example, the toe arm and the heel arm may have different return profiles (e.g., length, material, thickness, absorption and return profile, etc.) for user's of different weights. The energy return sole may be customized and created based on the needs of individual users or organizations.

The energy sole may be incorporated into a shoe sole as single manufacturing process or as multiple steps. For example, the energy soles may be created and then separately integrated into a shoe sole. For example, any number of light weight energy return materials may be wrapped around or injected within the spaces of the energy sole. For example, the energy sole may be encompassed, wrapped, or injected with spring foams, such as thermoplastics and other cushioning materials (e.g. Boost produced by Adidas).

Although not specifically shown, the energy return sole may include any number of curvatures to support the lateral motion of the shoe, foot, and energy sold during use. For example, the outside edges of the energy sole may have a minor or substantial C-shape with C opening down toward the ground.

It is expected that the various embodiments may be combined by adding and removing portions (e.g., arms, flexions, supports, etc.) of the components to achieve more simple or complex embodiments or embodiments that are more suitable for the various potential uses. In addition, the spacing between the different components may be varied based on the user, conditions, desired response and so forth. As used herein the term "or" is not mutually exclusive.

In one embodiment, the energy sole may be integrated with other structural components of the shoes, such as sidewalls, steel toes, ankle supports or so forth. The supports or arms may extend through all or portions of the shoe like fingers to provide better energy transfer into the energy sole as well as energy return from the energy sole to all or portions of the foot. For example, the energy sole may support the ankle motion of the foot and leg. The illustrative embodiments provide simplified energy soles, designs, and processes that may reduce user fatigue and injuries.

As shown and described herein, any of the described embodiments and respective components including arms, portions, extensions, or contacts may be combined in any number of embodiments and combinations of embodiments that are herein contemplated and expected. The previous detailed description is of a small number of embodiments for implementing the invention and is not intended to be limiting in scope. The following claims set forth a number of the embodiments of the invention disclosed with greater particularity.

What is claimed is:

1. An energy return sole for increasing the overall efficiency of a shoe, the shoe comprising a toe portion, a heel portion and a midfoot portion extending between the toe portion and the heel portion, the energy return sole comprising:

a base structure being curved for conforming to a bottom of a user's foot and adapted to extend under the toe, heel and midfoot portions of the shoe;

a toe arm extending from a midfoot portion of the base structure and extending forwardly to a toe portion of the base structure;

a heel arm extending from a midfoot portion of the base structure and extending rearwardly to a heel portion of the base structure;

wherein the toe arm and heel arm form a smooth arc which is continuous and concavely shaped in its entirety, and wherein the smooth arc extends from a first tip of the toe arm, wherein the first tip is located in the toe portion of the base structure, to a second tip of the heel arm, wherein the second tip is located in the heel portion of the base structure.

2. The energy return sole according to claim 1, wherein the base structure abuts a shoe sole, wherein the shoe sole is in direct contact with the bottom of the foot of the user.

3. The energy return sole according to claim 1, wherein the toe arm includes a toe contact, and wherein the heel arm includes a heel contact.

4. The energy return sole according to claim 1, wherein a toe contact is integrated with the toe arm, wherein the toe content extends forward and rearward from the toe arm, wherein a heel contact is integrated with a heel arm, and wherein the heel content extends forward and rearward from the heel arm.

5. The energy return sole according to claim 1, wherein the energy return sole is formed from carbon fiber.

6. The energy return sole according to claim 1, wherein the energy return sole is formed from metal.

7. The energy return sole according to claim 1, wherein the base structure is connected to one or more of the toe arm and the heel arm by a flexion, wherein the toe arm abuts the base below the toe portion of the shoe when compressed, and wherein the heel arm abuts the base below the heel portion of the shoe when compressed.

8. An article of footwear comprising a shoe, the shoe comprising a toe portion, a heel portion and a midfoot portion extending between the toe portion and the heel portion, the shoe comprising:

an upper portion and an energy return sole;

the energy return sole comprising:

a base structure being curved for conforming to a bottom of a user's foot and adapted to extend under the toe, heel and midfoot portions of the shoe;

a toe arm extending from a midfoot portion of the base structure and extending forwardly to a toe portion of the base structure;

a heel arm extending from a midfoot portion of the base structure and extending rearwardly to a heel portion of the base structure; and at lease two contacts extending from the at least two springs arms;

wherein the toe arm and heel arm form a smooth arc which is continuous and concavely shaped in its entirety, and wherein the smooth arc extends from a first tip of the toe arm, wherein the first tip is located in the toe portion of the base structure, to a second tip of the heel arm, wherein the second tip is located in the heel portion of the base structure.

9. The article of footwear according to claim 8, wherein components of the energy sole are encompassed in an energy returning material.

10. The article footwear of claim 8, wherein the at least two contacts include a toe contact and the heel contact, and wherein the toe contact and the heel contact extend forward and rearward from the at least two spring arms, respectively.

11. An energy sole for increasing the overall efficiency of a shoe, the shoe comprising a toe portion, a heel portion and a midfoot portion extending between the toe portion and the heel portion, the energy sole comprising:

a base structure for conforming to a bottom of a user's foot and adapted to extend under the toe, heel and midfoot portions of the shoe;

a toe arm extending from a midfoot portion of the base structure and extending forwardly to a toe portion of the base structure;

a heel arm extending from a midfoot portion of the base structure and extending rearwardly to a heel portion of the base structure;

wherein the toe arm and heel arm jointly form a large, substantially open C-shaped spring which is continuous and concavely shaped in its entirety; and wherein the spring extends from a first tip of the toe arm, wherein the first tip is located in the toe portion of the base structure, to a second tip of the heel arm, wherein the second tip is located in the heel portion of the base structure.

12. The energy sole according to claim 11, wherein the toe arm includes a toe contact, and wherein the heel arm includes a heel contact.

13. The method according to claim 11, wherein the base structure is integrated in the shoe sole, and wherein the base structure being curved for conforming to a bottom of a user's foot.

14. The energy sole according to claim 11, wherein components of the energy sole are encompassed in an energy returning material.

15. The energy sole according to claim 14, wherein the energy returning material is foam.

16. The energy sole according to claim 11, wherein a toe contact is integrated with the toe arm, and wherein a heel contact is integrated with a heel arm.

17. The energy sole according to claim 11, wherein the toe arm and a front portion of the base structure form a first V-spring, wherein the heel arm and a rear portion of the base structure form a second V-spring, and wherein a toe contact extends forward and rearward from the toe arm, and wherein a heel contact extends forward and rearward from the heel arm.

18. The energy sole according to claim 11, wherein the energy sole is formed from carbon fiber.

19. The energy sole according to claim 11, wherein the toe arm abuts the base below the toe portion of the energy sole when compressed, and wherein the heel arm abuts the base below the heel portion of the energy sole when compressed.

* * * * *